US010241437B2

(12) United States Patent
Fujihara

(10) Patent No.: US 10,241,437 B2
(45) Date of Patent: Mar. 26, 2019

(54) IMAGE FORMING APPARATUS WITH AN IMPROVED ADJUSTMENT PATCH FOR TONER DENSITY ADJUSTMENT

(71) Applicant: KYOCERA Document Solutions Inc., Osaka (JP)

(72) Inventor: Kensuke Fujihara, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 15/369,694

(22) Filed: Dec. 5, 2016

(65) Prior Publication Data

US 2017/0160669 A1 Jun. 8, 2017

(30) Foreign Application Priority Data

Dec. 8, 2015 (JP) ..... 2015-239738

(51) Int. Cl.
*G03G 15/06* (2006.01)
*G03G 15/00* (2006.01)

(52) U.S. Cl.
CPC ..... *G03G 15/065* (2013.01); *G03G 15/55* (2013.01)

(58) Field of Classification Search
CPC ..... G03G 15/065
See application file for complete search history.

(56) References Cited

U.S. PATENT DOCUMENTS

| | | | | |
|---|---|---|---|---|
| 2005/0281572 | A1 | 12/2005 | Kawakami | |
| 2009/0016750 | A1 | 1/2009 | Kobayashi | |
| 2013/0034359 | A1* | 2/2013 | Shirafuji | G03G 15/161 399/49 |

FOREIGN PATENT DOCUMENTS

| | | | |
|---|---|---|---|
| JP | 6-130767 | | 5/1994 |
| JP | 08286475 | A * | 11/1996 |
| JP | H09-054487 | | 2/1997 |
| JP | 2003-255628 | | 9/2003 |
| JP | 2006-3558 | | 1/2006 |
| JP | 2009-15211 | | 1/2009 |
| JP | 2010-107727 | | 5/2010 |
| JP | 2010107727 | A * | 5/2010 |

OTHER PUBLICATIONS

Machine translation of JP08-286475.*
Machine translation of JP2010-107727.*

* cited by examiner

*Primary Examiner* — David M. Gray
*Assistant Examiner* — Andrew V Do

(57) ABSTRACT

An exposure device irradiates a light beam to the photoconductor drum and thereby forms an electrostatic latent image on a photoconductor drum. A developing roller causes toner to adhere to the electrostatic latent image and thereby develops a toner image. A development bias power supply circuit applies a development bias to the developing roller. A direct current detection circuit detects a direct current that flows between the development bias power supply circuit and the developing roller. A control circuit (a) causes the exposure device to form an electrostatic latent image of an adjustment patch for toner density adjustment, (b) measures a value of the direct current at a timing when the developing roller causes the toner to adhere to the electrostatic latent image of the adjustment patch, and (c) performs the toner density adjustment on the basis of the measured value of the direct current.

3 Claims, 4 Drawing Sheets

IMAGE FORMING APPARATUS WITH AN IMPROVED ADJUSTMENT PATCH FOR TONER DENSITY ADJUSTMENT

CROSS-REFERENCE TO RELATED APPLICATIONS

This application relates to and claims priority rights from Japanese Patent Application No. 2015-239738 filed on Dec. 8, 2015, the entire disclosures of which are hereby incorporated by reference herein.

BACKGROUND

1. Field of the Present Disclosure

The present disclosure relates to an image forming apparatus.

2. Description of the Related Art

In order to restrain toner density fluctuation due to eccentricity of a photoconductor drum and/or a development roller, an image forming apparatus detects a value of an alternating current induced by a development bias, and adjusts a direct current component of the development bias on the basis of the detected value of the alternating current and thereby performs toner density adjustment.

Specifically, the eccentricity results in changing a distance between the photoconductor drum and the development roller, and consequently a capacitance between them also changes. The value of the alternating current induced by the development bias is changed in accordance with the change of the capacitance between them, and therefore, on the basis of the value of the alternating current, the toner density is adjusted so as to restrain toner density fluctuation due to eccentricity of a photoconductor drum and/or a development roller.

However, in the aforementioned image forming apparatus, the toner density adjustment is performed uniformly in a primary scanning direction (i.e. an axis direction of the photoconductor drum and the development roller), and therefore, if the toner density fluctuation occurs along the primary scanning direction, the toner density fluctuation along the primary scanning direction is not adequately restrained.

For example, if an axis of the photoconductor drum and an axis of the development roller are not in parallel to each other and one of them tilts to the other, then a toner density at one end of a printable range in the primary scanning direction is higher than a toner density at the other end of the printable range. However, such toner density fluctuation is not restrained in the aforementioned image forming apparatus. Similarly, if an axis of the photoconductor drum or an axis of the development roller is curved or bent, then a toner density at a center portion a printable range in the primary scanning direction is higher than a toner density at both ends of the printable range. However, such toner density fluctuation is not restrained in the aforementioned image forming apparatus.

SUMMARY

An image forming apparatus according to an aspect of the present disclosure includes a photoconductor drum, an exposure device, a developing roller, a development bias power supply circuit, a direct current detection circuit, and a control circuit. The exposure device is configured to irradiate a light beam to the photoconductor drum and thereby form an electrostatic latent image on the photoconductor drum. The developing roller is configured to cause toner to adhere to the electrostatic latent image on the photoconductor drum and thereby develop a toner image. The development bias power supply circuit is configured to apply a development bias to the developing roller. The direct current detection circuit is configured to detect a direct current that flows between the development bias power supply circuit and the developing roller. The control circuit is configured to (a) cause the exposure device to form an electrostatic latent image of an adjustment patch for toner density adjustment, (b) measures a value of the direct current using the direct current detection circuit at a timing when the developing roller causes the toner to adhere to the electrostatic latent image of the adjustment patch, and (c) performs the toner density adjustment on the basis of the measured value of the direct current.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
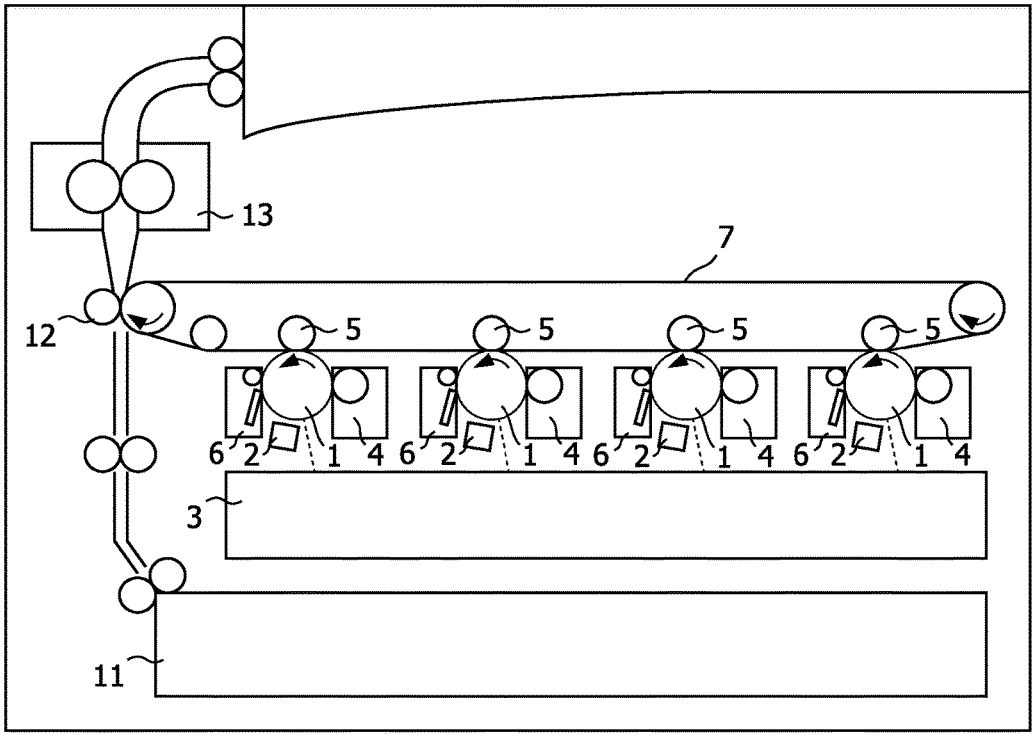
FIG. 1 shows a side view that indicates an internal mechanical configuration of an image forming apparatus in an embodiment according to the present disclosure.
Figure 2:
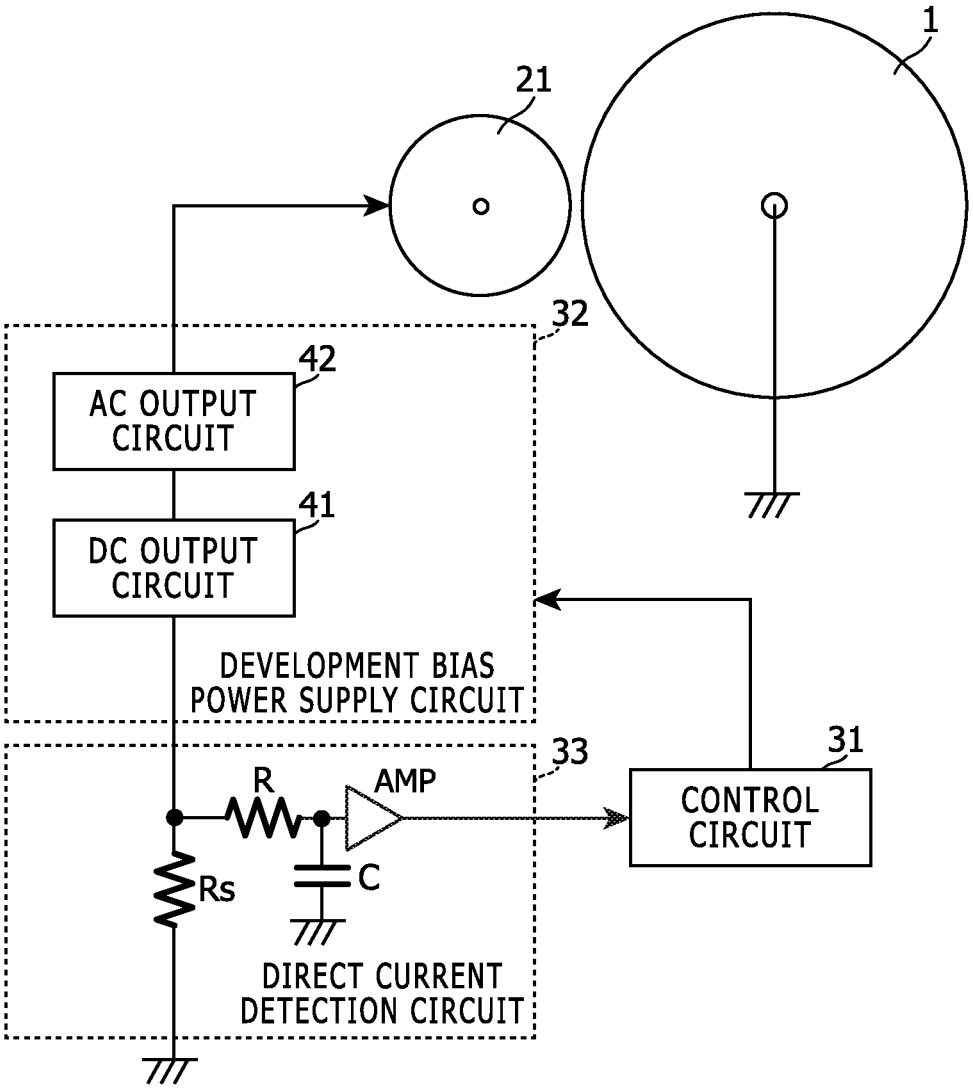
FIG. 2 shows a block diagram that indicates an electronic configuration of the image forming apparatus in the embodiment according to the present disclosure.

FIG. 1 shows a side view that indicates an internal mechanical configuration of an image forming apparatus in an embodiment according to the present disclosure. FIG. 2 shows a block diagram that indicates an electronic configuration of the image forming apparatus in the embodiment according to the present disclosure.

The image forming apparatus shown in FIGS. 1 and 2 is an apparatus having an electrophographic printing function, such as a printer, a facsimile machine, a copier, or a multi function peripheral. The image forming apparatus in the present embodiment includes a tandem-type color development device. For each color of Cyan, Magenta, Yellow and Black, this color development device includes a photoconductor drum 1, a charging device 2, an exposure device 3, a development device 4, a transfer roller 5, a cleaning unit 6, and an unshown static electricity eliminator. It should be noted that this image forming apparatus includes no toner density sensors to detect a toner density of a toner image on the photoconductor drum 1, an intermediate transfer belt 7 or the like.

In FIG. 1, the photoconductor drum 1 is a cylindrically shaped photoconductor and image carrier that an electrostatic latent image is formed on a surface thereof by the exposure device 3. As the photoconductor drum 1, an inorganic photoconductor is used such as an amorphous silicon photoconductor.

The charging device 2 charges a surface of the photoconductor drum 1 on the basis of a process condition.

The exposure device 3 is a device that irradiates a laser beam to the photoconductor drum 1 and thereby forms an electrostatic latent image on the photoconductor drum 1. The exposure device 3 includes a laser diode as a light source of the laser beam, and optical elements (such as lens, mirror and polygon mirror) that guide the laser beam to the photoconductor drum 1.

The development device 4 includes a developing roller 21 made of a conductive material, and the developing roller 21 moves toner supplied from an unshown toner container to the electrostatic latent image on the photoconductor drum 1 and thereby develops the electrostatic latent image with the toner and forms a toner image.

The transfer roller 5 transfers the toner image on the photo conductor drum 1 to an intermediate transfer belt 7. The cleaning unit 6 collects residual toner on the photoconductor drum 1 after the transfer of the toner image to the intermediate transfer belt 7. The intermediate transfer belt 7 is a loop-shaped intermediate transfer member that contacts the photoconductor drum 1, and onto which the toner image on the photoconductor drum 1 is transferred. The intermediate transfer belt 7 is hitched around a driving roller and the like, and rotates by driving force of the driving roller.

A transfer roller 12 causes a paper sheet conveyed from a paper feeding unit 11 to contact the intermediate transfer belt 7, and transfers the toner image on the intermediate transfer belt 7 to the paper sheet. The paper sheet on which the toner image has been transferred is transported to a fuser unit 13 and the toner image is fixed.

In FIG. 2, a control circuit 31 is electronically connected to a driving circuit that drives a motor to actuate the photoconductor drum 1, the intermediate transfer belt 7 or the like, the charging device 2, the exposure device 3, the development device 4 and the like, and controls these components and thereby performs a print process that includes forming an electrostatic latent image and developing a toner image in accordance with a currently set process condition. The control circuit 31 is embodied using a processor such as a CPU (Central Processing Unit) or an MPU (Microprocessing Unit), an ASIC (Application Specific Integrated Circuit) and/or the like.

A development bias power supply circuit 32 is a power supply circuit that applies a development bias specified by the control circuit 31 to the developing roller 21.

In the present embodiment, the development bias power supply circuit 32 includes a direct current output circuit 41 and an alternating current output circuit 42, and applies to the developing roller 21 the development bias obtained by adding a direct current voltage and an alternating current voltage (e.g. a square wave) specified by the control circuit 31 to each other.

A direct current detection circuit 33 is a circuit that detects a direct current that flows between the development bias power supply circuit 32 and the developing roller 21.

In the present embodiment, for example, as shown in FIG. 2, the direct current detection circuit 33 includes (a) a current sensing resistor Rs through which a current to be measured flows, (b) a CR low pass filter that removes an alternating current component from a voltage between ends of the current sensing resistor Rs, and (c) an amplifier AMP that amplifies output of the CR low pass filter.

Further, the control circuit 31 (a) causes the exposure device 3 to form an electrostatic latent image of an adjustment patch for toner density adjustment, (b) measures a value of the direct current using the direct current detection circuit 33 at a timing when the developing roller 21 causes the toner to adhere to the electrostatic latent image of the adjustment patch, and (c) performs the toner density adjustment on the basis of the measured value of the direct current. The adjustment patch is a toner image of a predetermined shape and a predetermined density (e.g. maximum density).

For example, the control circuit 31 causes the exposure device 3 to form an electrostatic latent image of an adjustment patch corresponding to a reference density and compares a reference direct current value corresponding to the reference density and the measured direct current value with each other, and thereby determines a density correction coefficient for a position of this adjustment patch, and perform toner density adjustment for the position of this adjustment patch on the basis of the density correction coefficient. A density correction coefficient for any position other than the adjustment patch is derived, for example, by interpolation based on the density correction coefficient for the adjustment patch.

For example, (a) setting a ratio between the reference direct current value and the measured direct current value as the density correction coefficient, and (b) correcting a pixel value or an exposure output value for a pixel at the position of the adjustment patch in print image data by multiplying the pixel value or the exposure output value by the density correction coefficient may be performed as the toner density adjustment. Alternatively, for example, (a) setting a difference between the reference direct current value and the measured direct current value as the density correction coefficient, and (b) correcting a pixel value or an exposure output value for a pixel at the position of the adjustment patch in print image data by adding or subtracting the density correction coefficient to/from the pixel value or the exposure output value may be performed as the toner density adjustment.

In the aforementioned manner, the reference direct current value may be correctly determined in advance by an experiment or the like. Otherwise, the reference direct current value may be set to be equal to a direct current value measured for an adjustment patch at a center portion of a printable range. Further, otherwise, the reference direct current value may be set to be equal to an average of direct current values measured for all adjustment patches.

Further, in the present embodiment, the control circuit 31 (a) causes the exposure device 3 to form electrostatic latent images of plural adjustment patches for the toner density adjustment so that the electrostatic latent images overlap each other neither in a primary scanning direction nor in a secondary scanning direction (i.e. to form electrostatic latent images of the plural adjustment patches at respective unique positions both in the primary scanning direction and in the secondary scanning direction), (b) measures values of the direct current using the direct current detection circuit 33 at timings when the developing roller 21 causes the toner to adhere the electrostatic latent images of the plural adjustment patches, (c) determines a toner density distribution in the primary scanning direction on the basis of plural measured values of the direct current corresponding to the plural adjustment patches, and (d) performs toner density adjustment corresponding to the determined toner density distribution in the primary scanning direction.

Furthermore, in the present embodiment, the control circuit 31 causes the exposure device 3 to form the electrostatic latent images of the plural adjustment patches in turn at an interval in the secondary scanning direction. The interval is set to be equal to an outer circumferential length of the developing roller 21 (i.e. a length obtained as a product of a diameter of a cross section perpendicular to its axis and the circular constant Pi). Therefore, the development of plural adjustment patches is performed at one single position on an outer circumferential surface of the developing roller 21 and therefore is not influenced by development characteristic variation in a circumferential direction of the developing roller 21.

Further, the control circuit 31 may causes the exposure device 3 to form electrostatic latent images of at least three adjustment patches so that the electrostatic latent images overlap each other neither in a primary scanning direction nor in a secondary scanning direction where (a) an electrostatic latent image of one of the at least three adjustment patches is arranged between a center and one end in a printable width and (b) an electrostatic latent image of another one of the at least three adjustment patches is arranged between the center and the other end in the printable width. In this case, even if one or both of the photoconductor drum 1 and the developing roller 21 is/are curved or bent, then the toner density fluctuation is restrained effectively.

Figure 3:
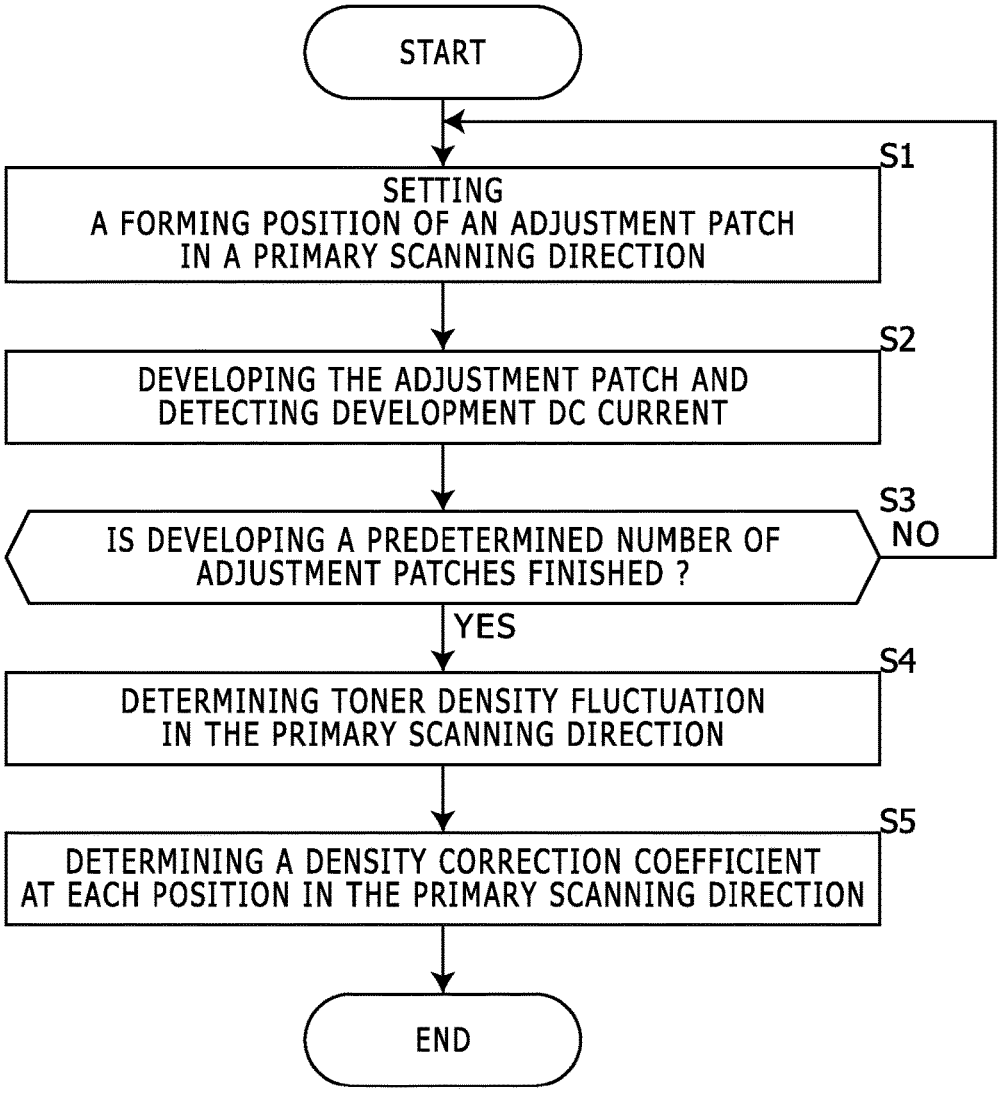
FIG. 3 shows a flowchart that explains a behavior of the image forming apparatus shown in FIGS. 1 and 2.
Figure 4:
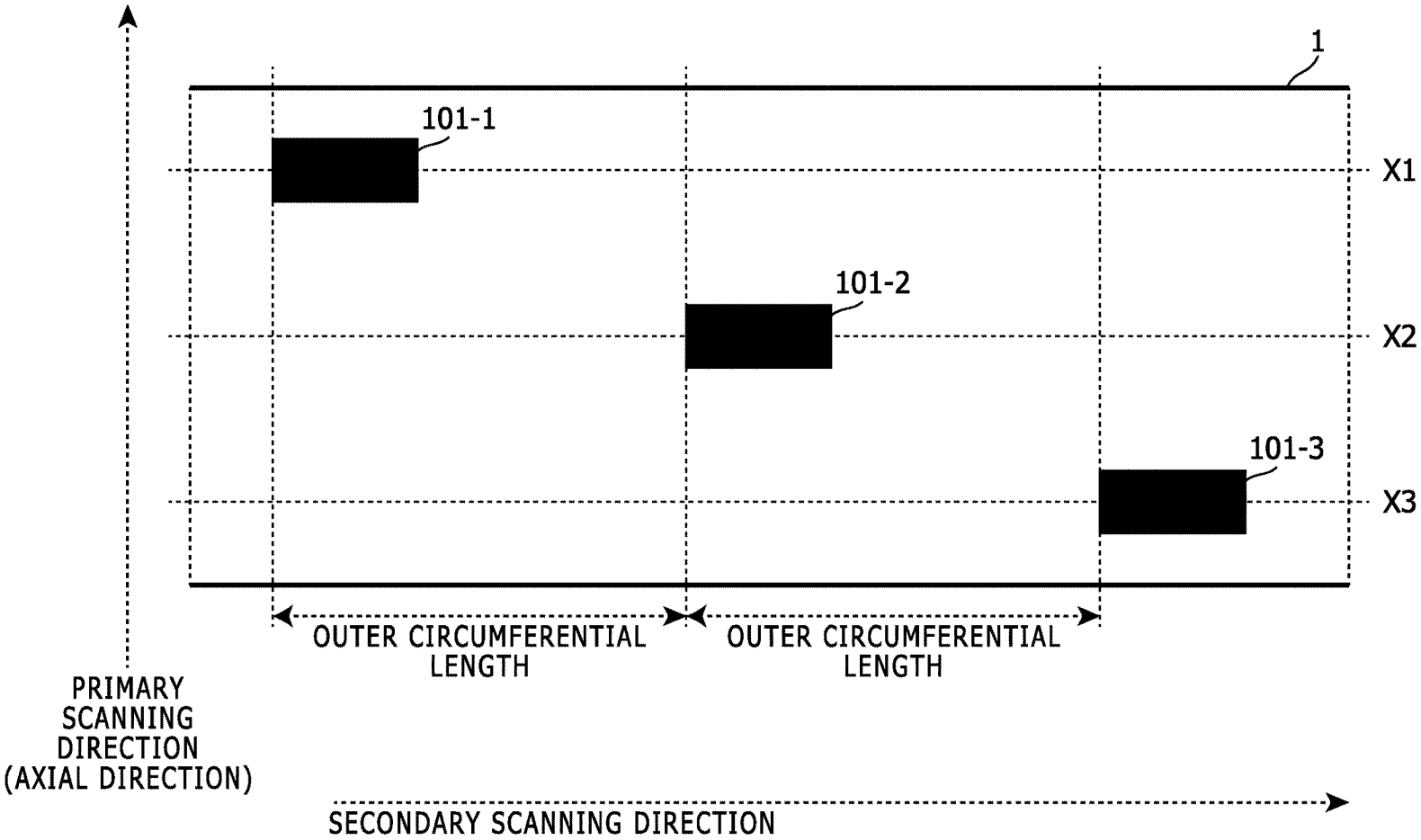
FIG. 4 shows a diagram that explains an adjustment patch formed on a photoconductor drum 1 in the image forming apparatus shown in FIGS. 1 and 2.

The following part explains a behavior of the aforementioned image forming apparatus for determining a toner density distribution in the primary scanning direction and adjusting a toner density on the basis of the toner density distribution. FIG. 3 shows a flowchart that explains a behavior of the image forming apparatus shown in FIGS. 1 and 2. FIG. 4 shows a diagram that explains an adjustment patch formed on a photoconductor drum 1 in the image forming apparatus shown in FIGS. 1 and 2.

The control circuit 31 determines a forming position Xi in the primary scanning direction for the i th adjustment patch 101-*i* in turn, and controls the exposure device 3 and specifies the position Xi to the exposure device and thereby forms an electrostatic latent image of the adjustment patch 101-*i* at the position Xi at a specific timing (in Step S1). Subsequently, the control circuit 31 watches a flowing direct current of the developing roller 21 using the direct current detecting circuit 33, and detects a value of the flowing direct current at a timing of the development of the adjustment patch 101-*i* (in Step S2).

Subsequently, the control circuit 31 determines whether or not a predetermined number N (N>1) of adjustment patches 101-1 to 101-N have been developed (in Step S3), and if at least one adjustment patch 101-*i* has not been developed, then returning to Step S1, the control circuit 31 performs the aforementioned process for the next adjustment patch 101-(i+1) in the same manner. In this process, for the adjustment patch 101-(i+1), the control circuit 31 forms an electrostatic latent image of the adjustment patch 101-(i+1) using the exposure device 3 at a timing that causes an interval between this adjustment patch 101-(i+1) and the previous adjustment patch 101-*i* to be equal to an outer circumferential length of the developing roller 21. Consequently, the adjustment patches 101-1 to 101-N are developed at one single position on the outer circumferential length of the developing roller 21.

For example, as shown in FIG. 4, three adjustment patches 101-1 to 101-3 are developed at constant intervals in the primary scanning direction and in the secondary scanning direction.

After finishing the development of a predetermined number N of the adjustment patches 101-1 to 101-N, the control circuit 31 determines toner density fluctuation (i.e. a toner density distribution) in the primary scanning direction on the basis of values of the flowing direct current at timings of the development of a predetermined number N of the adjustment patches 101-1 to 101-N (in Step S4), and determines a density correction coefficient at each position in the primary scanning direction on the basis of the determined toner density fluctuation (toner density distribution) (in Step S5).

Afterward, when performing a print process of an image based on print image data, on the basis of the density correction coefficients determined as mentioned, the control circuit 31 adjusts a value of the print image data or exposure output of the exposure device 3 at each position in the image with the density correction coefficient corresponding to the each position, and thereby adjusts the toner density and proceeds with the print process.

In the aforementioned embodiment, the development bias power supply circuit 32 applies a development bias to the developing roller 21. The direct current detection circuit detects a direct current that flows between the development bias power supply circuit 32 and the developing roller 21. Further, the control circuit 31 (a) causes the exposure device 3 to form an electrostatic latent image of an adjustment patch for toner density adjustment, (b) measures a value of the direct current using the direct current detection circuit 33 at a timing when the developing roller 21 causes the toner to adhere to the electrostatic latent image of the adjustment patch, and (c) performs the toner density adjustment on the basis of the measured value of the direct current.

Consequently, without using a toner density sensor, toner density fluctuation in the primary scanning direction is restrained by detecting a local toner density in the primary scanning direction.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

For example, in the aforementioned embodiment, the control circuit 31 may (a) cause the exposure device 3 to form electrostatic latent images of plural adjustment patches corresponding to plural gradation levels at one position in the primary scanning direction, (b) measure values of the direct current using the direct current detection circuit 33 at timings when the developing roller 21 causes the toner to adhere to the electrostatic latent images of the plural adjustment patches, and (c) perform toner gradation adjustment on the basis of the measured plural values of the direct current.

In such a case, plural adjustment patches corresponding to plural gradation levels different from each other in the primary scanning direction are considered as one patch set, and when developing the adjustment toner patches for gradation adjustment at plural positions in the primary scanning direction, an electrostatic latent image of each adjustment patch in each patch set is formed so that any two patch sets overlap each other neither in the primary scanning direction nor in the secondary scanning direction. The plural adjustment patches corresponding to plural gradation levels in a patch set may be formed spatially continuously or may be formed intermittently at a predetermined constant interval.

What is claimed is:

1. An image forming apparatus, comprising:

a photoconductor drum;

an exposure device configured to irradiate a light beam to the photoconductor drum and thereby form an electrostatic latent image on the photoconductor drum;

a developing roller configured to cause toner to adhere to the electrostatic latent image on the photoconductor drum and thereby develop a toner image;

a development bias power supply circuit configured to apply a development bias to the developing roller; the development bias power supply circuit comprising of a direct current output circuit and an alternating current output circuit and the development bias is comprised of outputs from the direct current output circuit and the alternating current output circuit;

a direct current detection circuit configured to detect a direct current that flows between the development bias power supply circuit and the developing roller; and a control circuit configured to (a) cause the exposure device to form an electrostatic latent image of an adjustment patch for toner density adjustment, (b) measures a value of the direct current using the direct current detection circuit at a timing when the developing roller causes the toner to adhere to the electrostatic latent image of the adjustment patch, and (c) performs the toner density adjustment on the basis of the measured value of the direct current;

wherein the control circuit (a1) causes the exposure device to form electrostatic latent images of plural adjustment patches for the toner density adjustment so that the electrostatic latent images overlap each other neither in a primary scanning direction nor in a secondary scanning direction, (b1) measures values of the direct current using the direct current detection circuit at timings when the developing roller causes the toner to adhere the electrostatic latent images of the plural adjustment patches, and (c1) performs the toner density adjustment in the primary scanning direction on the basis of plural measured values of the direct current corresponding to the plural adjustment patches; and wherein the control circuit causes the exposure device to form the electrostatic latent images of the plural adjustment patches in turn in the secondary scanning direction at an interval of an outer circumferential length of the developing roller.

2. The image forming apparatus according to claim 1, wherein:

the control circuit causes the exposure device to form electrostatic latent images of at least three adjustment patches so that the electrostatic latent images overlap each other neither in a primary scanning direction nor in a secondary scanning direction;

an electrostatic latent image of one of the at least three adjustment patches is arranged between a center and one end in a printable width; and an electrostatic latent image of another one of the at least three adjustment patches is arranged between the center and the other end in the printable width.

3. The image forming apparatus according to claim 1, wherein the control circuit (a) causes the exposure device to form electrostatic latent images of plural adjustment patches corresponding to plural gradation levels at one position in the primary scanning direction, (b) measures values of the direct current using the direct current detection circuit at timings when the developing roller causes the toner to adhere to the electrostatic latent images of the plural adjustment patches, and (c) performs toner gradation adjustment on the basis of the measured plural values of the direct current.

* * * * *